US006592025B2

(12) United States Patent
Bazany et al.

(10) Patent No.: US 6,592,025 B2
(45) Date of Patent: Jul. 15, 2003

(54) TOTE BOX WITH CORNER ENHANCERS, CLIPS AND TOP RAIL

(75) Inventors: Donald J. Bazany, Grand Haven, MI (US); Judson A. Bradford, Holland, MI (US)

(73) Assignee: Bradford Company, Holland, MI (US)

( * ) Notice: Subject to any disclaimer, the term of this patent is extended or adjusted under 35 U.S.C. 154(b) by 39 days.

(21) Appl. No.: 10/066,972

(22) Filed: Oct. 22, 2001

(65) Prior Publication Data

US 2002/0179701 A1 Dec. 5, 2002

Related U.S. Application Data

(63) Continuation-in-part of application No. 09/657,114, filed on Sep. 7, 2000, now Pat. No. 6,305,601, which is a continuation-in-part of application No. 09/335,944, filed on Jun. 18, 1999, now abandoned.

(51) Int. Cl.[7] ..... B65D 5/44

(52) U.S. Cl. ..... 229/199; 220/4.28; 220/642; 229/198.1; 229/918; 229/919

(58) Field of Search ..... 229/198.1, 199, 229/915, 918, 919; 206/509, 512; 220/4.28, 4.33, 641, 642, 646, 651, 652

(56) References Cited

U.S. PATENT DOCUMENTS

| | | | | | |
|---|---|---|---|---|---|
| 2,191,291 | A | * | 2/1940 | Smith | 229/117.16 |
| 5,037,027 | A | * | 8/1991 | Nichols | 229/198.1 |
| 5,429,261 | A | * | 7/1995 | Machino | 220/4.28 |
| 5,520,477 | A | * | 5/1996 | Fink | 220/642 |
| 5,522,539 | A | * | 6/1996 | Bazany | 229/199 |
| 5,531,326 | A | * | 7/1996 | Hummel et al. | 220/642 |
| 6,305,601 | B1 | * | 10/2001 | Bazany et al. | 229/199 |
| 6,349,877 | B1 | * | 2/2002 | Bradford | 229/199 |
| 6,460,724 | B1 | * | 10/2002 | Bradford | 220/642 |

* cited by examiner

*Primary Examiner*—Gary E. Elkins
(74) *Attorney, Agent, or Firm*—Wood, Herron & Evans, L.L.P.

(57) ABSTRACT

A tote box is disclosed which incorporates a box, four corner enhancers and a top rail which is secured over the top edge of the erected walls of the box. The walls of the box are held together with the corner enhancers without the benefit of any mechanical fasteners such as rivets or the like. The top rail is secured onto the box by a hook which engages tabs extending outwardly from the walls of the box or clips secured to the box walls. The top rail has a vertical lip which facilitates stacking multiple tote boxes.

15 Claims, 7 Drawing Sheets

TOTE BOX WITH CORNER ENHANCERS, CLIPS AND TOP RAIL

CROSS-REFERENCE TO RELATED APPLICATION

This application is a continuation-in-part application of U.S. patent application Ser. No. 09/657,114 filed Sep. 7, 2000 entitled "Tote Box with Corner Enhancers and Top Rail," now U.S. Pat. No. 6,305,601, which application is herein incorporated by reference in its entirety. U.S. patent application Ser. No. 09/657,114 is a continuation-in-part application of U.S. patent application Ser. No. 09/335,944 filed Jun. 18, 1999 now abandoned, entitled "Tote Box with Corner Enhancers and Top Rail," now abandoned, which application is herein incorporated by reference in its entirety.

FIELD OF THE INVENTION

This invention relates to tote boxes and more particularly to tote boxes made from foldable box blanks and having self locking top rails to hold the blanks in an erected, assembled relationship.

BACKGROUND OF THE INVENTION

Containers which are returnable/reusable are useful for the transportation, storage, and display of goods in commerce. Such containers, commonly called tote boxes, must be of sufficiently rigid construction to enable safe and damage free transport and storage of goods contained therein. These tote boxes are frequently designed so as to be stacked or mounted in a nesting relation for convenient transportation or storage of the tote boxes. In order to be stackable, the upper edge of the tote box is typically reinforced with a top rail or rim member which is adapted to receive another tote box stacked thereupon.

It is conventional to use a variety of materials for the construction of such tote boxes. Such materials typically consist of corrugated paperboard, corrugated plastic sheet, sheet metal and other such materials which are not sufficiently rigid to support a number of filled tote boxes in stacked relation. Therefore, it is also conventional to reinforce the corners of the tote boxes with structural supports so that a lower tote box of a stack of tote boxes can adequately support the load of the upper tote boxes and goods therein without deformation, possibly resulting in damage to the goods contained therein.

Typically these tote box corner supports and top rails require additional fasteners such as rivets, staples, screws or the like to secure the top rail and the corner support to the box itself. These fasteners add material costs and manufacturing steps to the construction of the tote box thereby resulting in an expensive and difficult to assemble tote box.

One patent which discloses a tote box having corner supports and a top rail which are not held in place with additional fasteners such as rivets, staples, screws or the like is applicants' own U.S. Pat. No. 5,295,632. However, in both embodiments of tote box disclosed in this patent, the tote box blank must have end flaps in order to hold the corner supports in place. The use of end flaps requires additional material to form the box blank, resulting in additional cost to manufacture the tote box.

Accordingly, it is a primary objective of the present invention to provide a tote box made from a box blank, top rail and corner enhancers which facilitates assembly of the tote box without any fasteners and with a minimum of assembly steps and space.

Another objective of this invention has been to provide such a tote box which facilitates the stacking of additional tote boxes thereon without deformation of the tote box.

It is an additional objective of the present invention to provide a tote box corner enhancer which can be incorporated into the tote box with a minimum of assembly steps or operations, and which does not require additional fasteners to secure the corner enhancer to the walls of the tote box.

A further object of the present invention has been to reduce the amount of time and expense required to assemble a top edge and corner reinforced tote box.

SUMMARY OF THE INVENTION

The present invention is directed to a tote box which is assembled from a die cut box blank, at least one corner enhancer and a self-locking top rail. When folded into the appropriate shape, the die cut box blank results in a bottom, two opposed end walls, and two opposed side walls. The end walls and side walls have coplanar upper edges defining a top edge of the box. The erected end walls preferably have holes into which reinforcing hand holds may be inserted to aid in manual handling of a loaded tote box.

To hold the erected box blank in an assembled relationship and to reinforce the top edge of the tote box, a channel shaped top rail extends around the top edge of the tote box. This top rail has a downwardly open channel formed between a pair of channel side walls. This downwardly open channel is at a minimum approximately twice, and preferably three times, the thickness of the box blank. When the downwardly open channel of the top rail is pushed down over the top edge of the erected box blank, the channel fits over a double thickness of the tote box formed from tabs or flaps extending from the side and end walls of the box blank. The top rail is locked onto the top edge of the box as the result of an inwardly extending hook on the bottom of at least one channel side wall which snaps beneath downwardly folded tabs on the upper edges of at least two opposed side and end walls of the tote box.

The top rail is preferably manufactured from a single piece of extruded plastic or aluminum. However, the top rail may be constructed of other materials such as steel, for example. Preferably, the top rail is made of one piece of material having a pair of opposed ends. In order to create a generally rectangular top rail, the unitary piece of material is notched at four corners, folded at each corner notch and then the ends of the unitary piece of material are welded together to form the top rail which can then simply be snapped down over the erected tote box. Alternatively, the top rail may be constructed of multiple pieces of material welded or otherwise joined together. Preferably, the welds are at the corners of the top rail but may be located along the sides of the top rail. The inwardly extending hook on the bottom of at least one channel side wall engages the downwardly folded tabs thereby securing the top rail onto the top edge of the tote box without the need for further fasteners such as screws, rivets, or staples. The top rail preferably has a vertical lip which extends around the periphery of the top rail. The vertical lip enables nested stacking of additional tote boxes. A first or upper tote box may be nestably stacked on a second or lower tote box by placing the bottom of the first tote box within the vertical lip of the top rail of the second or lower tote box.

Structural corner enhancers reside at each corner of the tote box to hold the erected side and end walls together in an assembled relationship and to stiffen the tote box corners. The corner enhancers provide a load path for the weight of the stacked tote boxes and their contents to be distributed downwardly and thereby provide structural integrity to the tote box and prevent side and end wall deformation. Each corner enhancer has a first and second open leg channel, each open leg channel being formed between a pair of leg channel walls. Each of the open leg channels has a width of approximately the thickness of the box blank so that one of the end walls is frictionally held inside one of the open leg channels of a corner enhancer and one of the side walls is frictionally held inside the other open leg channel of the corner enhancer. In this manner, each corner enhancer functions to join together an end wall and a side wall in an orthogonal or right angle relationship. These corner enhancers hold the side and end walls of the box together, without the need for mechanical fasteners to secure the corner enhancers in place. Upon assembly, each corner enhancer has an upper portion which is located inside the downwardly open channel of the top rail.

In order to assemble the tote box of the present invention the die cut box blank is erected and the side and end walls of the erected box blank inserted into the open leg channels of the corner enhancers. A side edge of each side wall and a corresponding side edge of an adjacent end wall are located inside the open leg channels of each of the corner enhancers in order to hold and maintain the walls in an erect vertical position, orthogonal to each other. Once the box blank has been folded and the walls of the box blank inserted into the open leg channels of the corner enhancers at the corners of the box, the top rail is then snapped in place over the upper edges of the box walls and the upper portions of the corner enhancers.

In an alternative embodiment of the present invention, the tabs of the tote box do not extend downwardly from the upper edges of the box but rather are integrally formed from a pair of opposed side walls, a pair of opposed end walls or all four walls. In this embodiment, the tabs are located below the upper edge of the upper edges of the walls and are defined by cuts, at least portions of which are negative cuts, made in the box walls. Although one configuration of cut is illustrated and described, the cuts may assume many other configurations without departing from the spirit of the invention of this application. Once such cuts are made in the box blank, the tabs are pushed inwardly toward the center of the box. Due to the negative angle of at least a portion of the cut of each tab, the tab is maintained in an extended position and does not return to its original position. Thus, the negative angles on at least a portion of the tabs created by the angle of the cuts keep the tabs directed inwardly, thus providing a catching surface for the inwardly extending hook at the bottom of at least one channel side wall of the top rail. Tabs maintained in such an extended position ensure that the top rail will lock over the upper edges of the side and end walls.

In yet another alternative embodiment of the present invention, a pair of opposed side walls, a pair of opposed end walls or all four walls each have at least one opening therein. In this alternative embodiment, the openings are located below the upper edges of the walls and are defined by cuts made in the box walls. Although a generally rectangular configuration of opening is illustrated and described, the openings may assume many other configurations without departing from the spirit of the invention of this application. Clips are engaged with or secured to these openings. Each clip has at least one outwardly directed flange or projection. These flanges or projections provide catching surfaces for an inwardly extending hook of at least one channel side wall of the top rail or a groove formed in at least one channel side wall of the top rail. Although one configuration of clip is illustrated and described, the clips may assume many other configurations without departing from the spirit of the invention of this application. The top rail locks over the upper edges of the side and end walls via use of the clips.

One advantage of the present invention is that the tote box can be assembled rapidly without the need for intermediate fastener joining steps and without the need for multiple rivets or fasteners such as have been conventional in prior art tote boxes as, for example, in the tote box disclosed in the assignee's own earlier U.S. Pat. No. 5,037,027. Another advantage of the present invention is that the stackable tote box may be constructed more quickly and less expensively than is presently possible in competitive type tote boxes.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
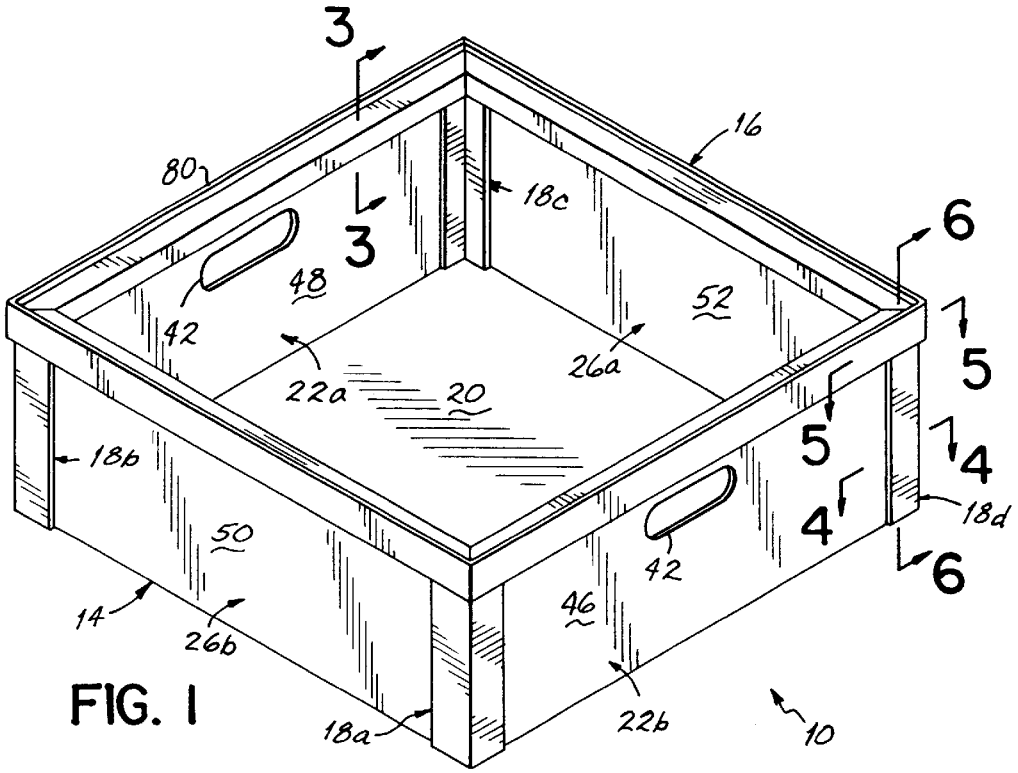
FIG. 1 is a perspective view of the assembled tote box of the present invention.
Figure 2:
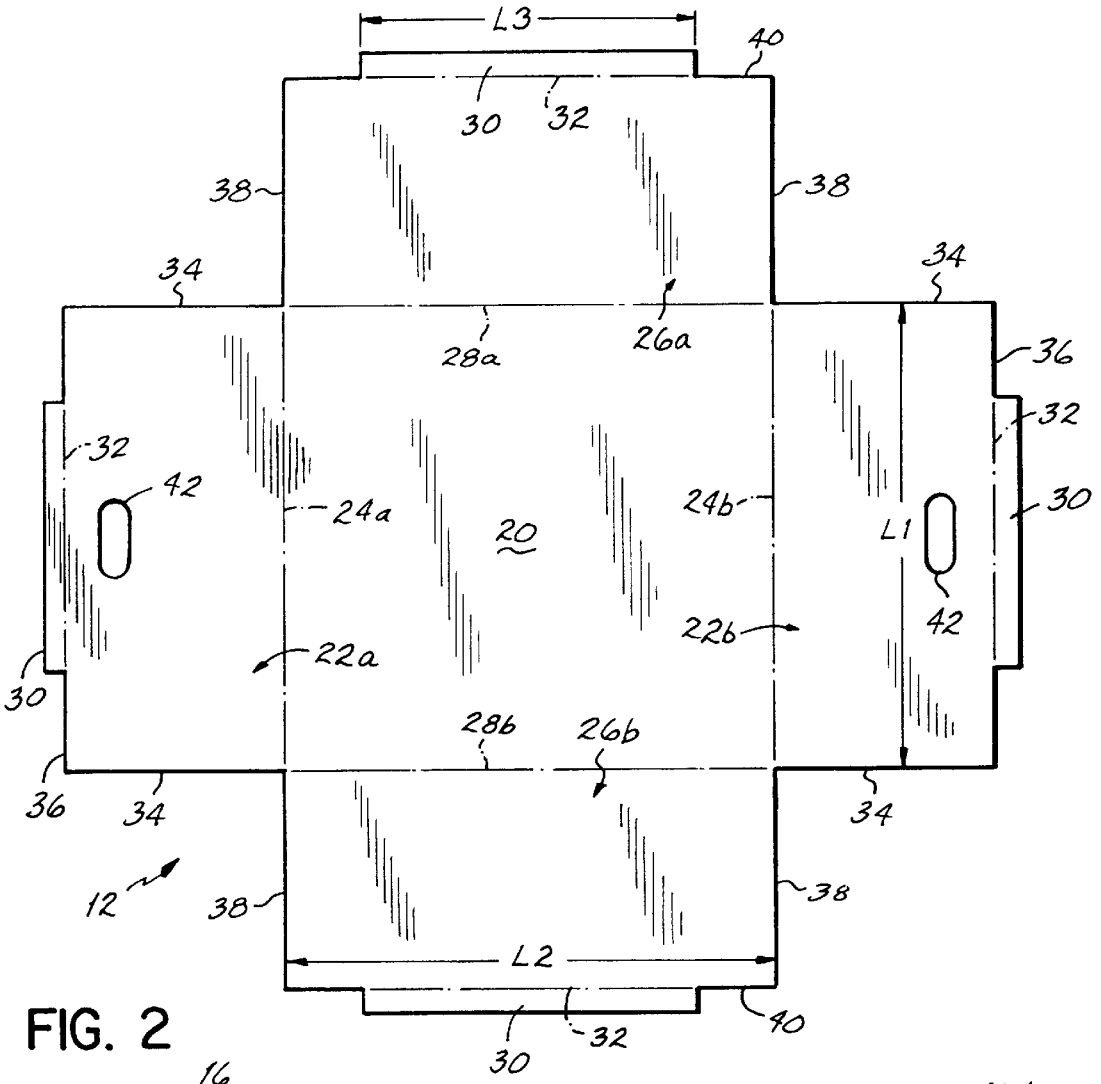
FIG. 2 is a top plan view of a box blank used to form the tote box of FIG. 1.

Referring to FIG. 1, there is illustrated an assembled tote box 10 according to the present invention. The tote box 10 is assembled from a uniform thickness box blank 12 as seen in FIG. 2 which is die cut or otherwise pre-cut from, preferably, corrugated plastic sheet. However, the box blank and resulting box may be made from any other suitable material. In one preferred embodiment, the box blank is 5 millimeters thick and made from extruded corrugated plastic material. Depending upon the application, the box blank may be other thicknesses or materials as well.

Figure 1A:
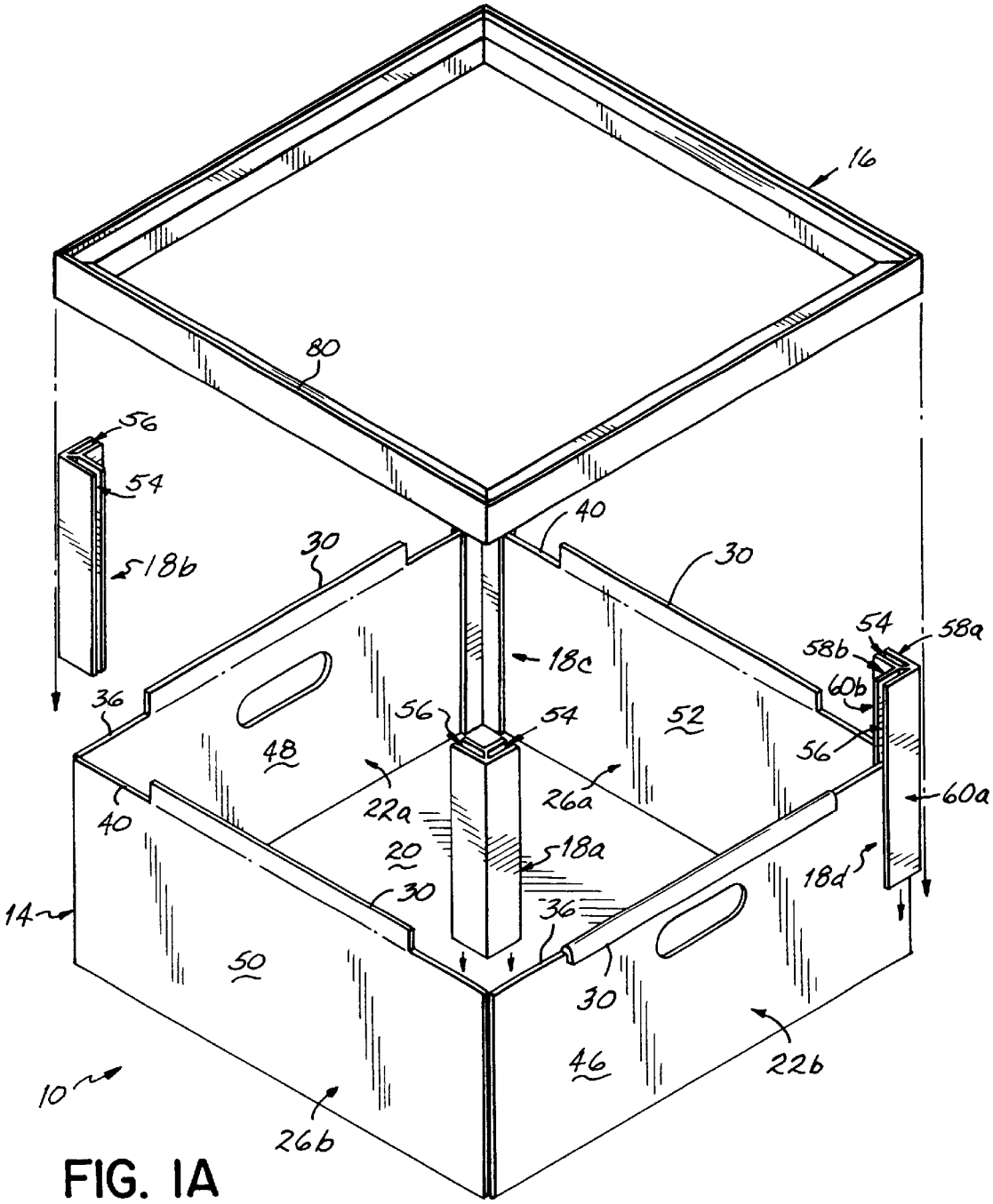
FIG. 1A is a partially disassembled perspective view of the tote box of FIG. 1.

As best illustrated in FIG. 1A, the tote box 10 comprises a box 14 formed from the foldable box blank 12 (shown in FIG. 2), a top rail 16, and four corner enhancers 18*a*–18*d*.

Referring to FIGS. 1A and 2, the box blank 12 is folded along fold lines to form a box 14 illustrated in FIG. 1A. As best illustrated in FIG. 2, the box blank 12 has a bottom 20, two end walls 22*a* and 22*b* connected to the bottom with fold lines 24*a* and 24*b*, two side walls 26*a*,26*b* connected to the bottom 20 by fold lines 28*a*,28*b*. In one preferred embodiment, each of the side walls 26*a*,26*b* and each of the end walls 22*a*,22*b* has a tab 30 which is joined to the wall with a fold line 32. As best illustrated in FIGS. 1A and 2, each end wall 22*a*,22*b* has a pair of opposed side edges 34 and an upper edge 36. Similarly, each of the side walls 26*a*,26*b* has a pair of opposed side edges 38 and an upper edge 40.

As best illustrated in FIG. 2, each of the opposed end walls 22*a,b* has an identical first length L1, and each of the opposed side walls 26*a,b* have an identical length L2. In the preferred embodiment of the present invention illustrated in FIG. 2, the lengths L1,L2 of the end walls 22*a,b* and side walls 26*a,b*, respectively are identical, resulting in a square box 14. However, for purposes of the present invention they may be of different lengths in order to create a rectangular box rather than a square box. Oval shaped holes 42 are cut through the end walls 22*a*,22*b* and may accommodate hand holds (not shown) which preferably are fabricated from plastic or aluminum but be constructed of any material. Although the holes 42 are illustrated as being formed in the end walls, they may alternatively be placed in the side walls 26*a*,26*b*. As best illustrated in FIG. 2, each of the tabs 30 has a length L3 less than the length of the side walls L2 and the length of the end walls L1 in order to leave space proximate the corners for the corner enhancers 18*a*–*d*. The tabs 30 may all be the same length as illustrated or alternatively of differing lengths. In either case, the tabs 30 must not interfere with the insertion and function of the corner enhancers 18*a*–*d*.

As best illustrated in FIG. 1A, once the side walls 26*a,b* and end walls 22*a,b* of the box blank are folded along fold lines 24*a,b* and 28*a,b* into a generally vertical orientation, the ends walls 22*a*,22*b* each have an outside surface 46 and an inside surface 48. Similarly, each of the side walls 26*a*,26*b* has an outside surface 50 and inside surface 52.

Figure 4:
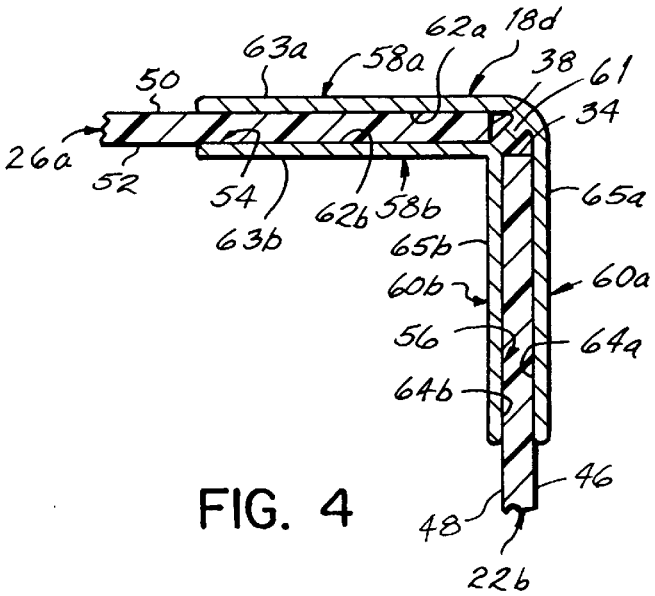
FIG. 4 is a cross-sectional view taken along the line 4—4 of FIG. 1.

Each of the corner enhancers 18*a*–18*d* is identically configured and has a first open leg channel 54 and a second open leg channel 56. As best illustrated in FIG. 4, the first open leg channel 54 is formed between a pair of leg channel walls 58*a,b* and second open leg channel 56 is formed between a pair of leg channel walls 60*a,b*. The first and second open leg channels of each corner enhancer are separated by a separator 61. Leg channel wall 58*a* has an inside surface 62*a* and an outside surface 63*a*, respectively. Likewise, leg channel wall 58*b* has an inside surface 62*b* and an outside surface 63*b*, respectively. The distance between the inside surfaces 62*a* and 62*b* of the leg channel walls 58*a,b* defines the width of the first open leg channel 54, which is approximately the thickness of the box blank 12. Likewise, the leg channel wall 60*a* of the second open leg channel 56 has an inside surface 64*a* and an outside surface 65*a*, respectively. Leg channel wall 60*b* of the second leg channel 56 also has an inside surface 64*b* and an outside surface 65*b*. The distance between the inside surfaces 64*a* and 64*b* of the leg channel walls 60*a*,60*b* defines the width of the second open leg channel 56, which is also approximately the thickness of the box blank 12. Because the width of the first and second open leg channels are approximately equal and approximately equal to the thickness of the side and end walls of the box blank, one of the end walls 22*a,b* and one of the side walls 26*a,b* are frictionally held inside the open leg channels of each corner enhancer. One of the open leg channels of each corner enhancer receives one of an adjacent side wall and end wall while the other open leg channel of the corner enhancer receives the other one of the adjacent side wall and end walls. For example, as illustrated in FIGS. 1A and 4, corner enhancer 18*d* joins together end wall 22*b* and side wall 26*a*, a portion of end wall 22*b* including side edge 34 being received within the second open leg channel 56 while a portion of side wall 26*a* including side edge 38 is received within the first open leg channel 54 of the corner enhancer 18*d*. Thus, each corner enhancer 18*a*–*d* functions to hold and maintain one of the end walls and one of the side walls in an orthogonal relationship in order to maintain the structural integrity of the box without the need for separate fasteners before the top rail 16 is placed over the box 14 and corner enhancers 18*a*–*d*.

Each corner enhancer 18*a*–*d* preferably has a height equal to the distance between the bottom of box 14 and the top edge of the box 14 (see FIG. 1A). However, corner enhancers of alternative heights may be used in accordance with the present invention as well.

Although one configuration of corner enhancer is illustrated and described, other configurations of corner enhancers may be used in accordance with the present invention. For example, each corner enhancer may comprise an "L-shaped" inner piece and an "L-shaped" outer piece held together, the distance between the inner and outer pieces defining a pair of open leg channels of a width approximately equal to the thickness of the box blank.

To assemble the box 14 illustrated in FIG. 1A from the box blank 12 illustrated in FIG. 2, the end walls 22*a*,22*b* are first folded upwardly along fold lines 24*a*,24*b*, respectively. Next, the side walls 26*a*, 26*b* are folded upwardly along fold lines 28*a*,28*b*, respectively. Once the side walls and end walls are erected, at each corner one of the side walls 26*a,b* is inserted into one of the open leg channels of one of the corner enhancers and one of the end walls 22*a,b* is inserted into the other open leg channel of the corner enhancer in order to hold and maintain one of the end walls and one of the side walls in an orthogonal vertical orientation or position. Because each of the open leg channels has a width of approximately the thickness of the box blank, each of the end walls and side walls are frictionally held inside one of the open leg channels of one of the corner enhancers. Once the walls are erected and held together with the corner enhancers 18*a*–*d*, the tabs 30 extending upwardly from each of the side and end walls are folded downwardly, either inwardly or outwardly. Although FIG. 1A illustrates one of the tabs 30 folded outwardly of end wall 22*b*, at least one or all of the tabs 30 may be folded inwardly of the respective side or end wall of which the tab 30 forms a part.

Figure 3:
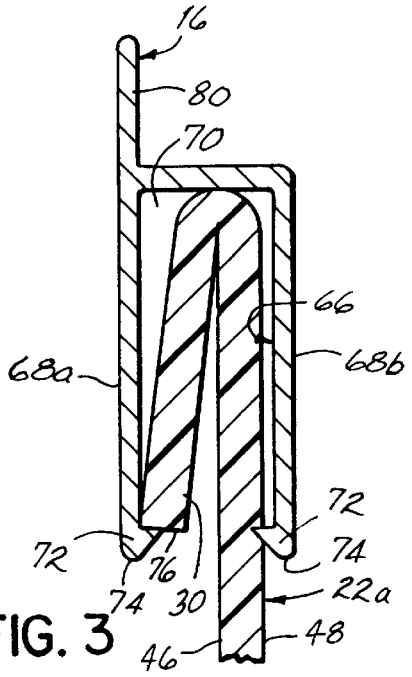
FIG. 3 is a cross-sectional view of a top rail and tote box wall taken on line 3—3 of FIG. 1.

Once the side walls and end walls of the tote box are erected and partially inserted into the open leg channels of the corner enhancers and the tabs folded downwardly, the final step in the assembly of the tote box is accomplished by snapping in place the top rail 16 over the top edge of the erected box. The top edge of the tote box is formed from upper edges 36 of end walls 22*a,b* and upper edges 40 of side walls 26*a,b*, respectively. Prior to securing the top rail 16, the tabs 30 must be folded downwardly upon the side and end walls. Once the tabs 30 are folded downwardly, the top rail 16 is snapped onto the top edge of the erected tote box. As shown in FIG. 3 the top rail 16 has a downwardly open channel 66 which is formed between two spaced channel side walls 68*a,b*. The channel 66 has an opening 70 of a width at least twice the thickness of the box blank and in one preferred embodiment, approximately three times the thickness of the box blank. As seen in FIG. 3, the channel opening 70 is of sufficient width to accommodate the end wall 22*b* and tab 30 folded outside thereof.

As illustrated in FIG. 3, an inwardly extending hook 72 is provided on a bottom edge 74 of each channel side wall 68*a,b* in the preferred embodiment. When the top rail 16 is snapped onto the erected tote box, one of the hooks 72 engages a bottom edge 76 of the downwardly folded tab 30 thereby securing the top rail 16 on the erected tote box as shown in FIG. 3. Once the top rail 16 is pressed onto the top edge of the tote box and one of the hooks 72 engages the downwardly folded tabs 30 of the side and end walls, the tote box is erected without the benefit of mechanical fasteners, rivets, staples, or the like. While the tab 30 is illustrated in FIG. 3 as being folded downwardly on the outside of the side wall, it could just as well be folded downwardly on the inside of this same wall. Although FIG. 3 illustrates an inwardly extending hook 72 on a bottom edge 74 of each channel side wall 68*a,b*, alternatively, only one of the channel side walls 68*a,b* could have an inwardly extending hook 72.

Figure 5:
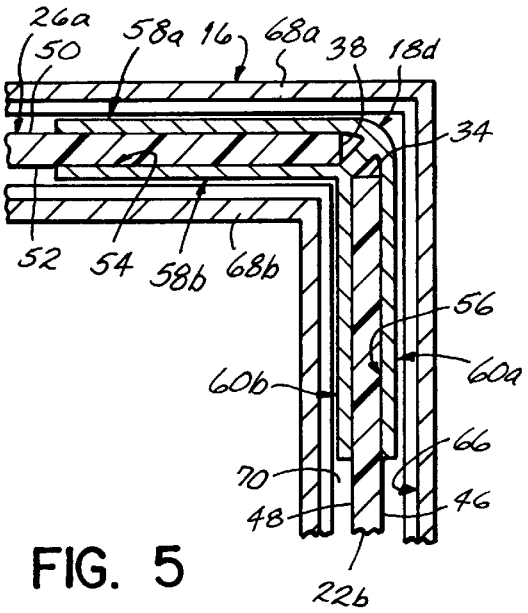
FIG. 5 is a cross-sectional view taken along the line 5—5 of FIG. 1.
Figure 6:
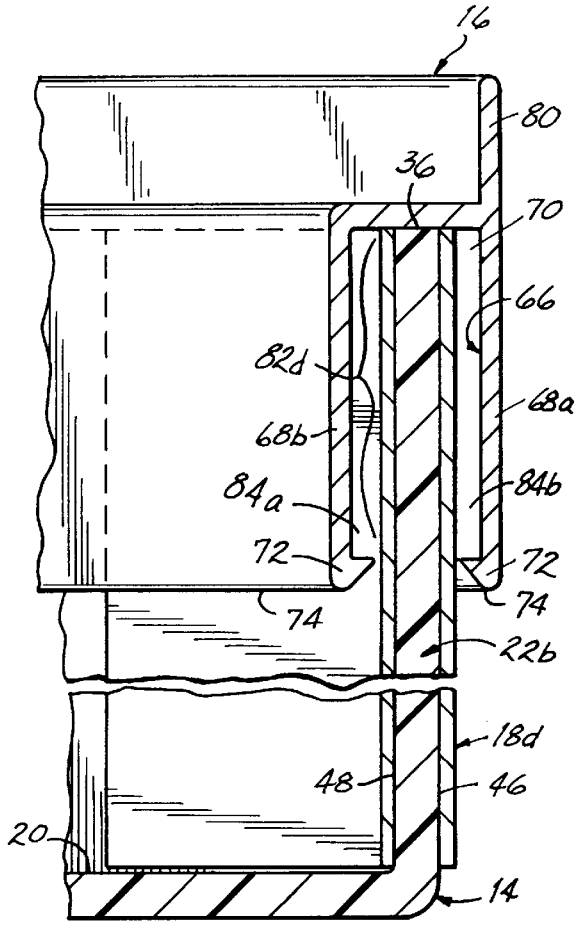
FIG. 6 is a cross-sectional view taken along the line 6—6 of FIG. 1.

As illustrated in FIGS. 5 and 6, each of the corner enhancers 18*a–d* has an upper portion 82*a–d* (only upper portion 82*d* being illustrated in FIGS. 5 and 6). These upper portions 82*a–d* of the corner enhancers 18*a–d* are located inside the downwardly open channel 66 formed between the pair of channel side walls 68*a,b* of the top rail 16 as best illustrated in FIG. 6. Because the width of the downwardly open channels is approximately twice the thickness of the box blank so as to fit over the downwardly folded tabs of the side and end walls, at each corner of the tote box there are gaps 84*a* and 84*b* located between the outside surfaces of the corner enhancer and the inside surfaces of the channel side walls of the top rail (see FIG. 6).

The top rail 16 of the present invention also has a vertically extending lip 80 on an outside upper edge thereof. The lip 80 facilitates the stacking of a second tote box in a nested relationship upon a tote box 10 of the present invention. The weight of the tote box stacked on the top rail is distributed around the top rail 16 and supported by the corner enhancers 18*a–d* of the present invention. Although one continuous, uniform configuration of top rail 16 is illustrated and described, the top rail 16 may assume other configurations as well, such as for example slots may be formed in the vertical lip 80 of the top rail 16 to receive strapping.

Figure 7:
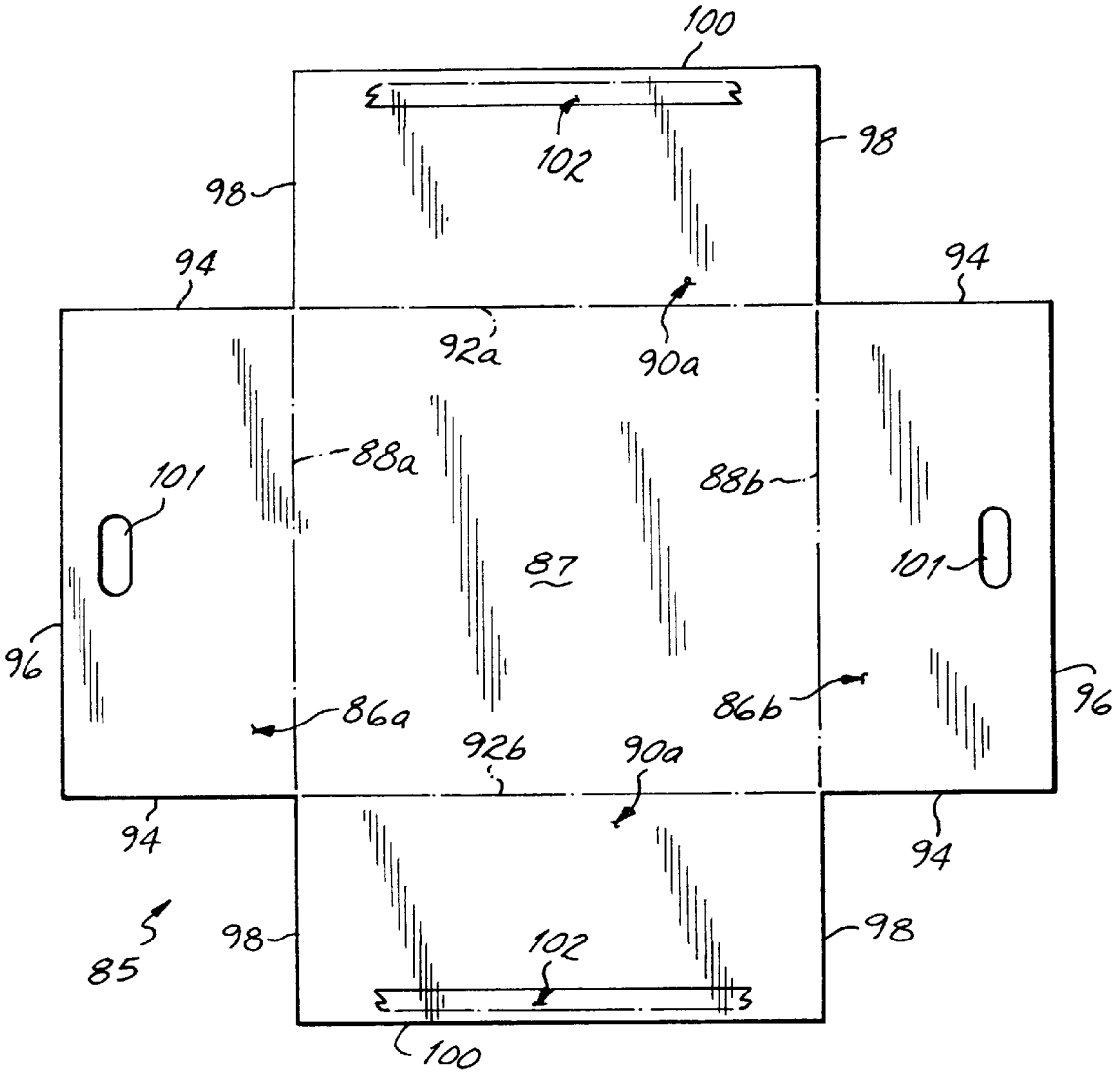
FIG. 7 is a top plan view of a box blank used to form an alternative embodiment of tote box of the present invention.

Referring to FIG. 7, there is illustrated a box blank 85 configured similarly to the box blank 12 illustrated in FIG. 2. The box blank 85 has a bottom 87, two end walls 86*a* and 86*b* connected to the bottom with fold lines 88*a* and 88*b*, and two side walls 90*a* and 90*b* connected to the bottom 87 with fold lines 92*a* and 92*b*. Each end wall 86*a*, 86*b* has a pair of opposed side edges 94 and an upper edge 96. Similarly, each side wall 90*a*, 90*b* has a pair of opposed side edges 98 and an upper edge 100. Holes 101 are formed in a pair of opposed walls or all four walls.

In this preferred embodiment of the present invention, each of the side walls 90*a*, 90*b* has a tab 102 formed therein. The tab 102 is spaced inwardly from the upper edge 100 of the side wall so that when the box walls are folded upwardly into a vertical orientation, the tabs 102 are below the upper edges 100 of the side walls 90*a*,90*b*. Although the tabs 102 are illustrated as being on a pair of opposed side walls, they may be located on opposed end walls only, or on all four walls of the box. In this embodiment the tabs 102 are illustrated having a length slightly less than the length of the side walls so as to not interfere with the corner enhancers. However, the tabs 102 may be any length desired.

Figure 8:
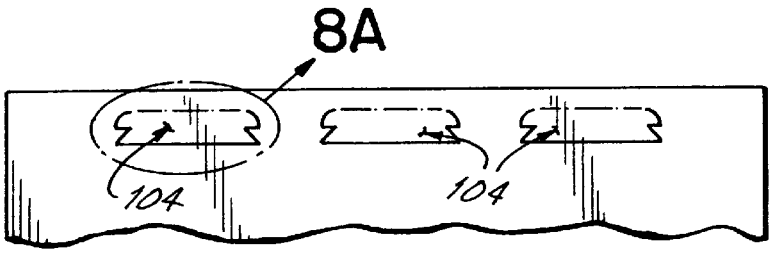
FIG. 8 is a top plan view of a portion of a box blank illustrating yet another alternative embodiment of the present invention.

FIG. 8 illustrates an alternative embodiment of the present invention in which each side wall has three tabs 104 rather than one continuous tab 102 as illustrated in FIG. 7. Again, such a series of tabs may be located on a pair of opposed end walls, on a pair of opposed side walls, or on all four walls.

Figure 8A:
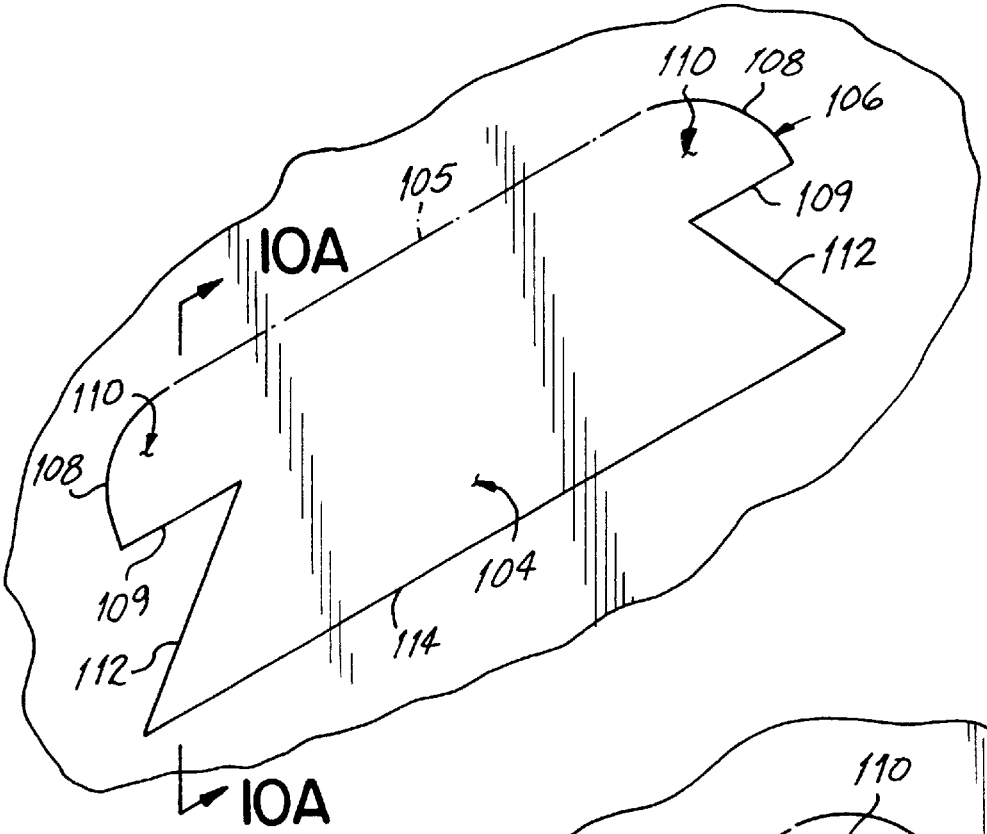
FIG. 8A is a perspective view of the encircled area 8A of FIG. 8.
Figure 8B:
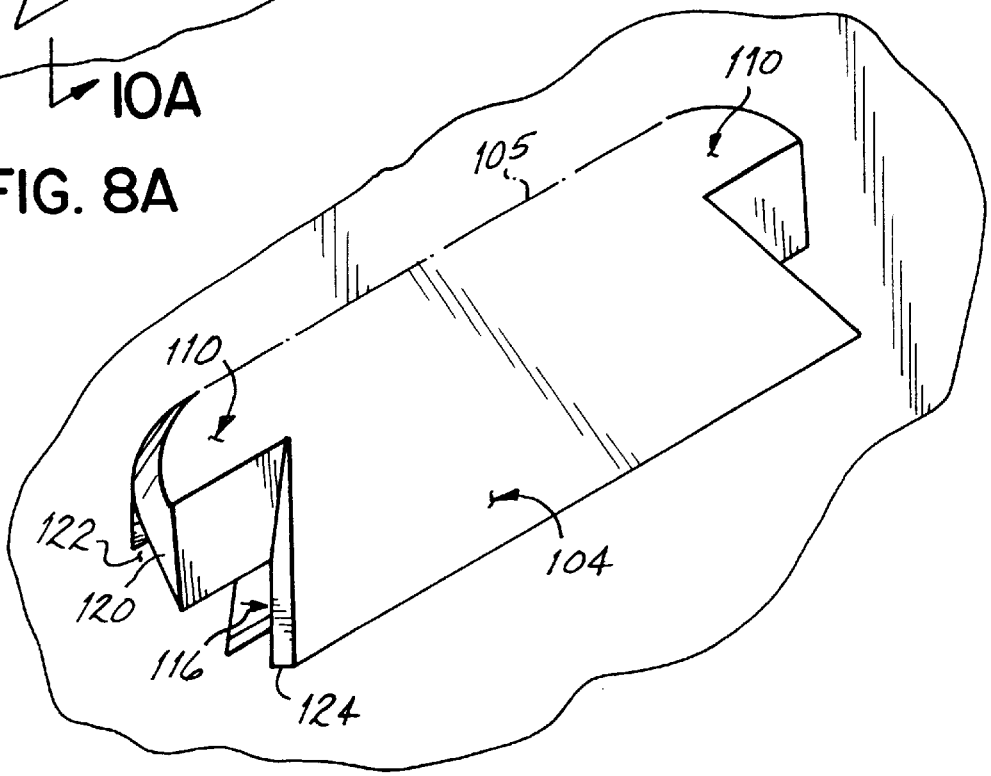
FIG. 8B is a perspective view of the tab of FIG. 8A pushed inwardly.
Figure 8C:
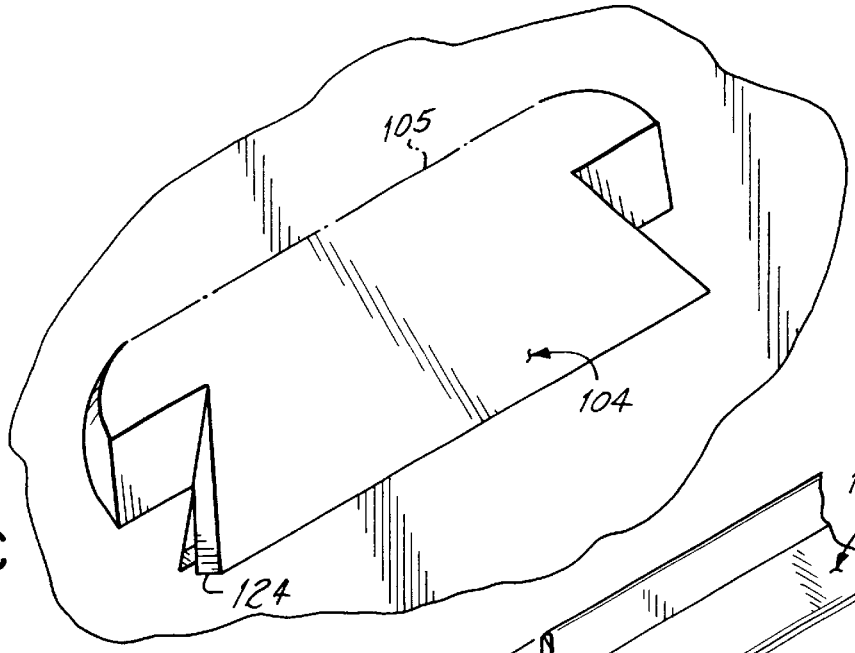
FIG. 8C is a perspective view of the tab of FIG. 8A in an at-rest position.
Figure 9:
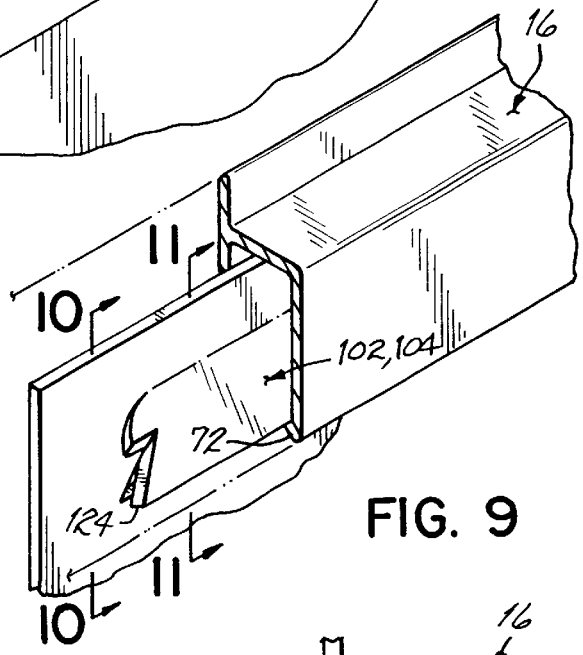
FIG. 9 is a perspective view of a tab engaged with the top rail of the present invention.

FIGS. 8A–8C illustrate the method by which the tabs 104 are moved from an inactive position illustrated in FIG. 8A to an active position illustrated in FIG. 8C. In an active position, the tab 104 functions to hold the top rail 16 over the top edge of the box as described hereinabove. Referring to FIG. 8A, the tab 104 is defined by a fold line 105 at the top of the tab 104 and a multi-surface cut 106 through the material of the box blank defining the lower edge of the tab 104. The multi-surface cut 106 comprises a pair of first portions 108 which are normal or perpendicular to the surface of the box blank, a pair of second portions 109 which are cut at a negative angle 118 to the surface of the box blank, third portions 112 which are cut perpendicular to the surface of the box blank and a bottom fourth portion 114 which is normal to the surface of the box blank.

Referring to FIG. 8B, once the cut 106 is made through the material of the box blank, the tab 104 is pushed in the direction of arrow 116 about fold line 105 so that the tab 104 moves inwardly toward the center of the assembled box.

Figure 10:
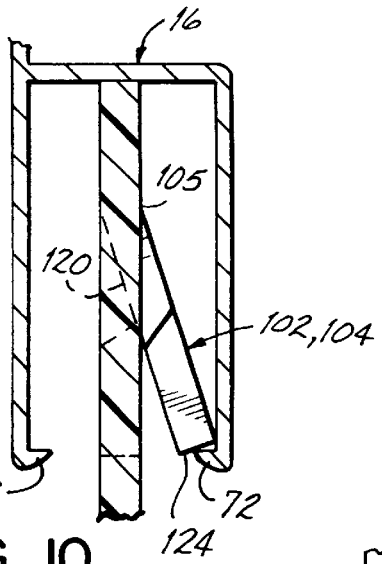
FIG. 10 is a cross-sectional view taken along the line 10—10 of FIG. 9.
Figure 10A:
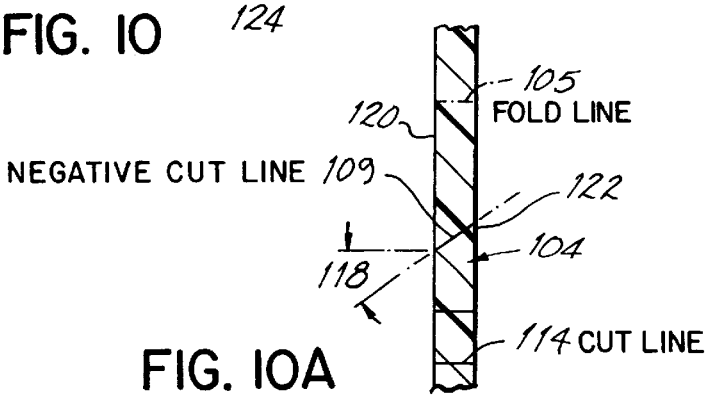
FIG. 10A is a cross-sectional view taken on line 10A—10A of FIG. 8A.
Figure 11:
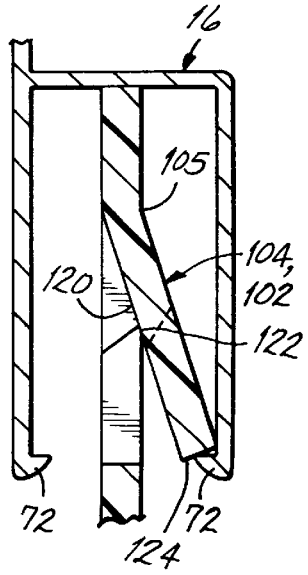
FIG. 11 is a cross-sectional view taken along the line 11—11 of FIG. 9.

Referring to FIG. 8C, once the tab 104 has been pushed inwardly from the plane of the box blank, the tab 104 is maintained in an extended, active position as illustrated in FIG. 8C due to the top portions 110 of the tab 104 (defined by the cuts 108,109) having the surface of cut 109 cut at a negative angle 118 as best illustrated in FIGS. 10,10A and 11. Thus, as illustrated in FIGS. 10,10A and 11, a first surface 120 of the tab 104 abuts against the inside surface 122 of the box wall. Due to the negative angle 118 along at least the top portion 110 of the tab, the tab 104 is prevented from returning to its original position illustrated in FIG. 8A and is maintained in an extended, active position.

In its extended position, when the top rail 16 is placed over the top edge of the box the hook 72 of one of the opposed side channel walls of the top rail 16 catches on the bottom surface 124 of the tab 104 so that the top rail 16 may not be removed without pushing inwardly on the tabs. Thus, due to the negative angle of at least one portion of the cut which is made to create a tab, the tab, once pushed out, is maintained in an extended position in which it will catch a hook on the bottom of one of the channel side walls of the top rail and prevent the top rail from being removed from the box.

Figure 13:
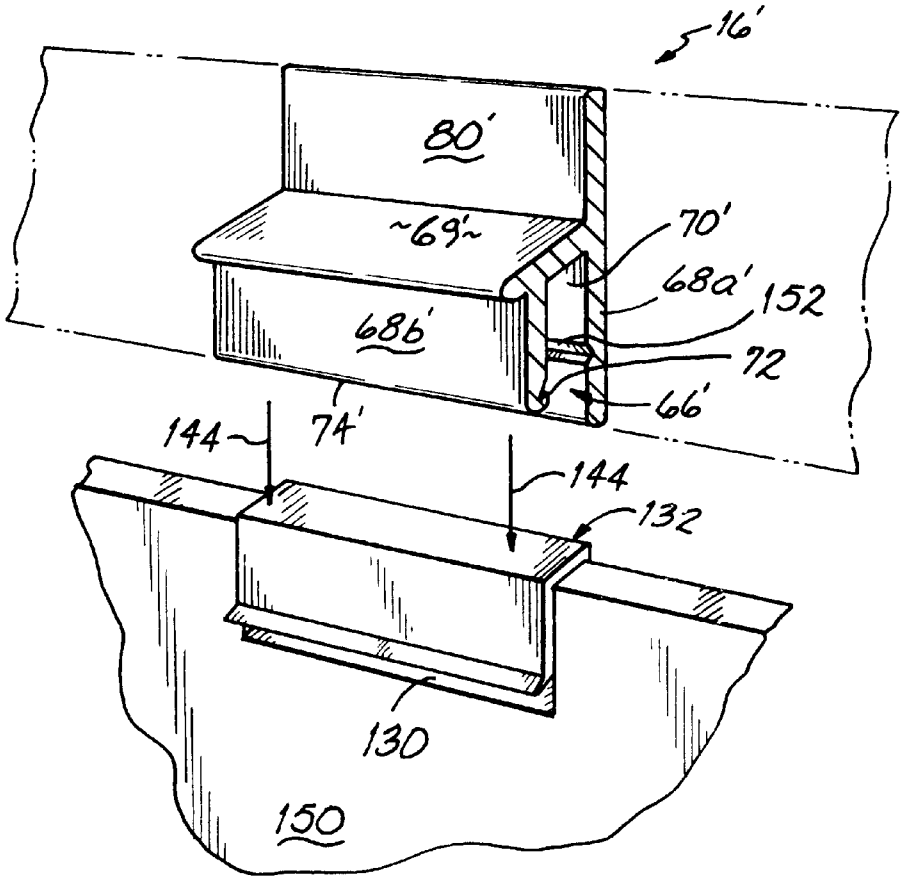
FIG. 13 is another perspective view of the alternative embodiment of FIG. 12 illustrating the top rail being secured to the clips engaged with openings in the box blank.
Figure 12:
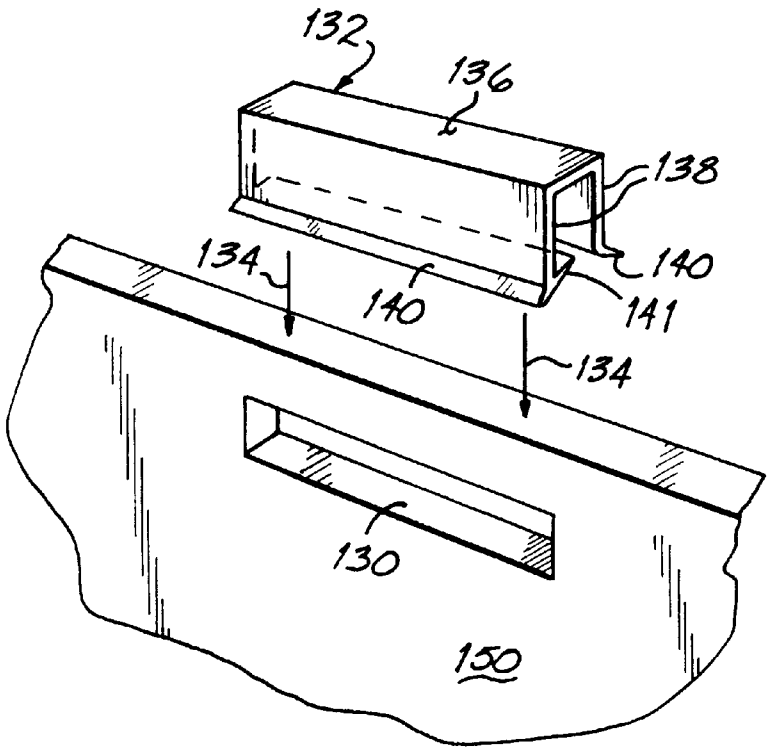
FIG. 12 is a perspective view of the alternative embodiment illustrating clips being secured to the box blank.

An alternative embodiment of the present invention is illustrated in FIGS. 12 and 13. In this embodiment, at least two of the walls 150 have openings 130 therein. The openings 130 are illustrated as being rectangular but may be oval, circular or any other shape or configuration. Any number of openings 130 may be located along the length of the wall beneath the upper edge of the wall. Preferably, a clip 132 is engaged with or inserted into each opening 130 by moving the clip in the downward direction of arrows 134. Each clip 132 has a generally U-shaped cross-sectional configuration including a top 136 and a pair of legs 138 extending downwardly from the top 136. At the bottom of each leg 138 is an outwardly extending flange or projection 140 extending the length of the clip 132. An inwardly directed flange or projection 141 is located at the bottom of at least one leg 138 to maintain engagement of the clip 132 and the opening 130. Although one configuration of clip 132 is illustrated and described, the clip 132 may assume other configurations in accordance with the present invention.

Once the clip 132 is engaged with the opening 130, a top rail 16' is lowered in the direction of arrows 144. For purposes of simplicity, the numbers used above to describe the top rail 16 will be used but with a prime. Although the cross-sectional configuration of the top rail 16' is different than the cross-sectional configuration of the top rail 16, either version may be used in this alternative embodiment. Additionally, any other configuration of top rail not illustrated may be used in accordance with the present invention. Top rail 16' has a downwardly open channel 66' formed between two spaced channel side walls 68*a*' and 68*b*' which extend downwardly from a channel top 69'. The channel 66' has an opening 70' which is of sufficient width to accommodate clip 132 and one of the side or end walls 150. See FIG. 13. Along the lower edge 74' of channel side wall 68' a hook 72' extends inwardly and is adapted to engage one of the flanges 140 of the clip 132. A groove 152 extends along the length of the channel side wall 68*a*' and is adapted to receive or engage the outermost flange 140 of the clip 132. A vertically extending lip 80' extends upwardly from channel side wall 68*a*'. The lip 80' facilitates stacking a second tote box in a nested relationship upon a tote box 10 made in accordance with the present invention.

In this embodiment, rather than engaging tabs, the hook 72' of the top rail 16' engages the innermost flanges 140 of clips 132 in order to secure the top rail 16' to the erected box. In accordance with the present invention, hooks formed on either of the channel side walls of the top rail could engage flanges extending outwardly from the clip's legs.

While we have described several preferred embodiments of the present invention, persons skilled in the art will appreciate changes and modifications which may be made without departing from the spirit of the invention. For example, the downwardly folded tabs may be located on only two opposed walls of the tote box rather than on all four walls to effectively secure the top rail to the tote box. Additionally, the inwardly folded tabs of the second embodiment may be located on all four walls of the tote box to effectively secure the top rail to the tote box or on only two opposed sides of the tote box. Therefore, we intend to be limited only by the scope of the following claims and equivalents thereof:

We claim:

1. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said walls having at least one opening therethrough, clips engaging said openings, a plurality of corner enhancers, each of said corner enhancers having first and second open leg channels, each open leg channel being formed between a pair of leg channel walls, each of said open leg channels having an uninterrupted width defined between planar inside surfaces of said leg channel walls, said width of said open leg channels being substantially the same as the thickness of said box blank, one of said end walls being located inside one of said first and second open leg channels and one of said side walls being located inside the other of said first and second open leg channels, and a top rail extending around the top edge of said box, said top rail having a downwardly open channel formed between a pair of channel side walls, said downwardly open channel being fitted over said upper edges of said side walls and said end walls, said downwardly open channel having a width of approximately twice the thickness of said box blank so as to fit over said clips engaged with said walls, at least one of said channel side walls having an inwardly extending hook for engaging said clips and locking said top rail over said upper edges of said end and side walls, said side and end walls of said box being prevented from separating from said open leg channels of said corner enhancers solely by interengagement of said top rail with said clips.

2. The tote box of claim 1 wherein said tote box has four corner enhancers.

3. The tote box of claim 1 wherein said at least one corner enhancer has a height equal to the distance between said bottom of said box and said top edge of said box.

4. The tote box of claim 1 wherein said foldable box blank is made of corrugated plastic sheet.

5. The tote box of claim 1 wherein said corner enhancers and said top rail are each extruded from a material of at least one of a group consisting of plastic and aluminum.

6. The tote box of claim 1 wherein said top rail has a vertical lip on an outside upper edge thereof for facilitating stacking of a second tote box on top of said tote box.

7. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said walls having openings therein, at least one clip engaged with each of said openings, four corner enhancers, each of said corner enhancers joining one of said end walls to one of said side walls, each of said corner enhancers having first and second open leg channels each formed between a pair of leg channel walls, each of said open leg channels having an uninterrupted width defined between planar inside surfaces of said leg channel walls, said width of said open leg channels being substantially the same as the thickness of said box blank so as to frictionally hold inside said first and second open leg channels one of said side walls and one of said end walls, and a top rail extending around the top edge of said box, said top rail having a downwardly open channel formed between a pair of channel side walls, said downwardly open channel being fitted over said upper edges of said side walls and said end walls, said downwardly open channel having a width of approximately twice the thickness of said box blank so as to fit over said clips, and an upper portion of each of said corner enhancers, said side and end walls of said box being maintained in an assembled relationship solely by interengagement of said top rail with said clips.

8. The tote box of claim 7 wherein at least one of said channel side walls has an inwardly extending hook for engaging one of said clips and locking said top rail over said top edge of said box.

9. The tote box of claim 7 wherein each of said corner enhancers has a height equal to the distance between said bottom of said box and said top edge of said box.

10. The tote box of claim 7 wherein said foldable box blank is made of corrugated plastic sheet.

11. The tote box of claim 7 wherein said corner enhancers and said top rail are extruded from a material of at least one of a group consisting of plastic and aluminum.

12. The tote box of claim 7 wherein said top rail has a vertical lip on an outside upper edge thereof for facilitating stacking of a second tote box on top of said tote box.

13. The tote box of claim 7 wherein each of said opposed side walls have an identical first length and each of said opposed end walls have an identical second length, said first length being greater than said second length.

14. The tote box of claim 13 wherein said clips have a length less than the first and second lengths of said side and end walls.

15. A tote box with a self-locking top rail comprising:

a box formed from a foldable box blank of a uniform thickness, said box having a bottom, two opposed side walls and two opposed end walls, said side walls and end walls having upper edges defining a top edge of the box, at least two of said walls having openings located below said upper edges of said walls, a plurality of clips placed in said openings, four corner enhancers, each corner enhancer joining one of said end walls to one of said side walls, each of said corner enhancers having first and second open leg channels each formed between a pair of leg channel walls, one of said end walls being located inside one of said first and second open leg channels and one of said side walls being located inside the other of said first and second open leg channels, and a top rail extending around the top edge of said box, said top rail having a downwardly open channel formed between a pair of channel side walls, said downwardly open channel being fitted over said upper edges of said side walls and said end walls, at least one of said channel side walls having a hook for engaging said clips, said side and end walls of said box being maintained in an assembled relationship solely by interengagement of said top rail with said clips.

* * * * *